United States Patent [19]

Simpson et al.

[11] Patent Number: 4,490,969

[45] Date of Patent: Jan. 1, 1985

[54] PLASTIC ENCAPSULATED WIRE ROPE

[75] Inventors: Neville H. Simpson; Thomas H. Dosemagen; David E. Dirks, all of Kenosha, Wis.

[73] Assignee: AMSTED Industries Incorporated, Chicago, Ill.

[21] Appl. No.: 479,000

[22] Filed: Mar. 25, 1983

[51] Int. Cl.[3] ..... D07B 1/16; D07B 7/12; D07B 7/14

[52] U.S. Cl. ..... 57/217; 57/7; 57/295

[58] Field of Search ..... 57/210, 212, 214, 217, 57/221, 223, 232, 7, 295, 296, 241

[56] References Cited

U.S. PATENT DOCUMENTS

| | | | |
|---|---|---|---|
| 2,904,846 | 9/1959 | Smith | 57/295 X |
| 3,646,748 | 3/1972 | Lang | 57/7 X |
| 3,882,665 | 5/1975 | Hughes et al. | 57/7 X |
| 3,889,455 | 6/1975 | Portinari et al. | 57/7 |
| 3,979,896 | 9/1976 | Klett et al. | 57/7 X |
| 4,017,579 | 4/1977 | Roe et al. | 57/7 X |
| 4,123,894 | 11/1978 | Hughes et al. | 57/220 |
| 4,197,695 | 4/1980 | Hughes et al. | 57/7 |
| 4,344,278 | 8/1982 | Jamison et al. | 57/217 X |
| 4,366,667 | 1/1983 | Oestreich et al. | 57/293 X |

*Primary Examiner*—Donald Watkins

*Attorney, Agent, or Firm*—Charles E. Bouton; Fred P. Kostka

[57] ABSTRACT

The present invention provides a method of manufacturing a thermoplastic encapsulated wire rope. Such thermoplastic encapsulated wire rope is quenched in a lubricant bath or spray to fill any openings in the thermoplastic with lubricant. The wire rope so produced is also part of the present invention.

3 Claims, 2 Drawing Figures

PLASTIC ENCAPSULATED WIRE ROPE

BACKGROUND OF THE INVENTION

The present invention generally relates to a method of manufacturing a thermoplastic encapsulated wire rope, and more specifically, to a method of quenching such thermoplastic encapsulated wire rope in a lubricant bath or spray to fill any openings in the thermoplastic with lubricant and to the encapsulated rope so produced.

The wire rope of the present invention usually will comprise lubricated strands encapsulated in a thermoplastic or an elastomer. Patents relating to such thermoplastic impregnation of wire ropes include U.S. Pat. Nos. 3,824,777 and 3,874,158. The individual wire strands are lubricated in an extrusion process with a conventional lubricant such as petrolatum at about room temperature, or with an asphaltic based lubricant which is applied at about 150° F. (65° C.). The lubricated strand rope is then thermoplastic encapsulated in an extrusion operation. The rope is heated to 150°-300° F. (51°-150° C.) and is passed through an extrusion die wherein the thermoplastic is injected into the rope, extending to the inner rope and between inner rope strands and outer rope strands and between outer rope strands. Such thermoplastic encapsulation inhibits the entrance of foreign abrasive particles into the rope, seals the lubricant within the rope for optimal lubrication life, minimizes rope metal to outside metal contact for increased rope strength and life, and locks the component strands in their respective fabricated positions to provide increased resistance to strand expansion such as popping or bird caging.

However, thermoplastic or elastomer encapsulation of the wire rope may actually promote corrosion if all possible interstices between rope strands are not filled either with a plastic, an elastomer or a lubricant. If not so filled, such interstices can entrap moisture within the rope and lead to corrosion.

The present invention accordingly provides a method of quenching the fully thermoplastic or elastomer encapsulated wire rope with a heavy fluid lubricant such as a petrolatum based, mineral based or combination thereof. When the lubricated rope exits the extrusion die first after thermoplastic or elastomer encapsulation, the rope is at about 150°-300° F. (51°-149° C.). When entering the quench bath trough or spray, being at 50°-100° F. (10°-38° C.), the wire rope cools very rapidly. Such cooling creates a vacuum within the interstices of the rope which causes the quenching lubricant to be drawn into the rope through any opening in the thermoplastic or elastomer coating.

The wire rope of the present invention could be of a swaged construction whereby a thermoplastic or an elastomer could be placed around the interior rope strands. The outer rope strands could then be wound around such thermoplastic or elastomer, and the entire rope then either roller or die compacted to embed the outer strands into the thermoplastic or elastomer. A patent relating to such outer strand compaction is U.S. Pat. No. 4,120,145.

SUMMARY OF THE INVENTION

Accordingly, the present invention provides a method of making wire rope comprising the steps of winding several lubricated multi-wire strands to form a wire rope, extruding a thermoplastic which extends into the interstices between the rope strands, surrounding the wire rope with a quenching lubricant at a temperature of 50°-100° F. (10°-38° C.) to cool the wire rope and to cause the quenching lubricant to be drawn into any openings in the thermoplastic to further lubricate the wire rope and to seal such openings.

Further, the present invention comprises a wire rope comprising several lubricated multi-wire strands, a thermoplastic extending into the interstices between said strands, said thermoplastic having several gaps with a lubricant located within the certain of said gaps to prevent the corrosion of said wire rope.

BRIEF DESCRIPTION OF THE DRAWINGS

In the drawings,

In FIG. 1, a lubricated thermoplastic encapsulated wire rope 95 is shown being passed through a bath of lubricant 96 in a container 97. Alternatively or concurrently, wire rope 95 could be sprayed with lubricant 94 from a supply 99 ejected from sprayers 98. Prior to entering the lubricant bath or spray, the wire rope 95 exited the extrusion head wherein the thermoplastic has been injected therein. As a result, the wire rope 95 is at a temperature of 150°-300° F. (50°-149° C.). The lubricant bath or spray is at an ambient temperature of 50°-100° F. (10°-38° C.). As a result, the wire rope is cooled rapidly when passed through. A vacuum is created in the interstices of the rope, which causes the lubricant quenching medium to be drawn into the rope through any openings in the surface of the thermoplastic encapsulating the rope. As the thermoplastic cools and shrinks about the rope, the quenching lubricant is locked within the rope and enhances the corrosion resistance of the rope by filling with lubricant such interstices which could trap moisture or eliminating them.

Referring now to FIG. 2, a wire rope made in accordance with the present invention is shown. The rope 50 is comprised of inner core strands 52, each comprising individual wires 54, intermediate strands 56, each comprising individual wires 58, and outer strands 60, each comprising individual wires 62. All strands 52, 56 and 60 contain an lubricant 64 which is located in the interstices between the wires comprising the strands. A thermoplastic or elastomer 66 is located in the interstices between inner core strands 52, intermediate strands 56 and outer strands 60. During the extrusion of thermoplastic or elastomer 66, certain voids or holes 68 will appear in varying numbers and sizes and may connect to openings at the surface. Such holes 68 are filled by lubricant 94 or 96 (shown in FIG. 1) drawn into the rope through any such opening in the thermoplastic or elastomer coating during the quenching of the rope described above.

Figure 1:
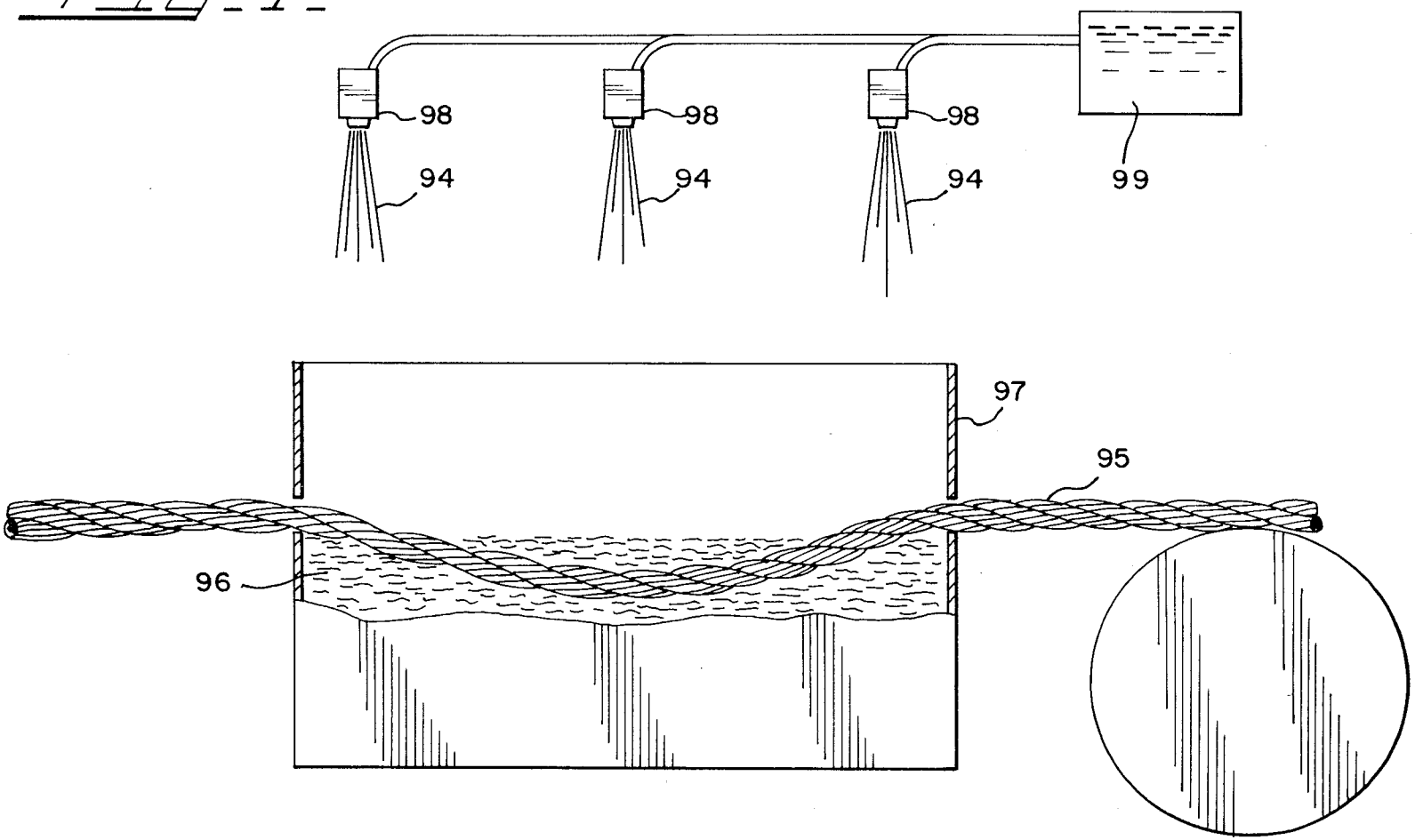
FIG. 1 is a sectional view of the wire rope lubricant quenching process of the present invention.
Figure 2:
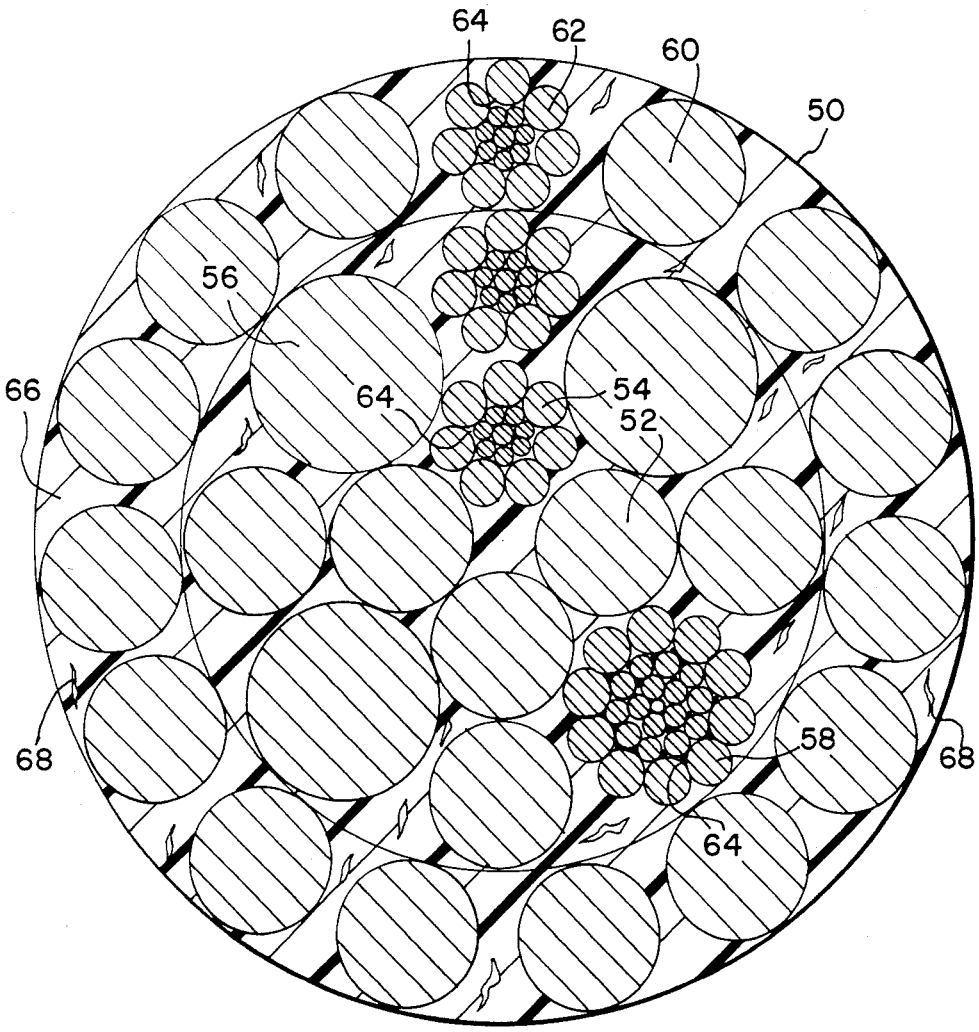
FIG. 2 is a cross section view of one embodiment of a wire rope made in accordance with the present invention.

What is claimed is:

1. In a method of making encapsulated wire rope including the steps of winding several lubricated multi-wire strands to form a wire rope, and extruding a heated thermoplastic thereon which extends into the interstices between the rope strands, the improvement comprising: surrounding the wire rope with a heavy fluid quenching lubricant at a temperature of 50°-100° F. (10°-38° C.) to cool the wire rope and to cause the quenching lubricant to be drawn into any openings in the thermoplastic to further lubricate the wire rope and to seal such openings.

2. The method of claim 1, wherein the surrounding of the wire rope by the quenching lubricant causes a partial vacuum in the wire rope which shrinks certain of the openings in the thermoplastic.

3. A wire rope comprising several lubricated multi-wire strands encapsulated by a thermoplastic extending into the interstices between said strands, and any openings in said thermoplastic being filled with a lubricant drawn therein during quenching of the encapsulated wire rope to prevent the corrosion of said wire rope.

* * * * *